US005706756A

United States Patent [19]

Cunningham et al.

[11] Patent Number: 5,706,756

[45] Date of Patent: Jan. 13, 1998

[54] FLAG FOR THROWING

[76] Inventors: Scott R. Cunningham; Heidi Cunningham, both of 8470 Edgemont Way, Colorado Springs, Colo. 80919

[21] Appl. No.: 530,590

[22] Filed: Sep. 19, 1995

[51] Int. Cl.[6] ..... G09F 17/00; A63B 65/00

[52] U.S. Cl. ..... 116/173; 273/55 R; 273/415

[58] Field of Search ..... 116/173, 55 R, 116/55 L, 318, 346, 347, 413–415, 423–428; D21/199; D10/46.1; 446/34, 36

[56] References Cited

U.S. PATENT DOCUMENTS

| | | | |
|---|---|---|---|
| D. 317,191 | 5/1991 | Williams et al. | D21/199 |
| 862,094 | 7/1907 | Morton | 273/426 |
| 3,091,215 | 5/1963 | Kenmore | 116/173 |
| 3,393,911 | 7/1968 | Lawson | 273/428 |
| 3,436,077 | 4/1969 | Geram | 116/173 |
| 3,852,910 | 12/1974 | Everett | 273/424 |
| 3,903,629 | 9/1975 | Gruna | 40/591 |
| 4,088,319 | 5/1978 | Clarke | 273/423 |
| 4,826,179 | 5/1989 | Callaghan | 273/428 |
| 5,310,194 | 5/1994 | Scheel | 273/415 |

FOREIGN PATENT DOCUMENTS

| | | | |
|---|---|---|---|
| 2608450 | 6/1988 | France | 273/426 |

OTHER PUBLICATIONS

Photographs of existing penalty flag used in sports ssuch as football.

*Primary Examiner*—William A. Cuchlinski, Jr.
*Assistant Examiner*—Andrew Hirshfeld
*Attorney, Agent, or Firm*—Lee R. Osman

[57] ABSTRACT

A flag for throwing having a flexible main body member, a flexible handle member having a first end attached to the main body member, and a throwing weight attached to the main body member. The throwing weight is attached to the main body member adjacent to the intersection of the handle member and the main body member, and is positioned in a pocket formed at the intersection of said main body member and said handle member.

12 Claims, 1 Drawing Sheet

FLAG FOR THROWING

FIELD OF THE INVENTION

This invention relates to a flag for throwing. More particularly, this invention relates to a new flag for throwing which allows a user to easily grip the flag and toss it quickly, accurately, and without damaging any item which it may contact.

BACKGROUND

People often express frustration at a particular situation by throwing items. However, throwing items is dangerous and can lead to property damage or even personal injury.

One scenario in which a person may desire to throw an item in frustration is while watching sports, either on television or in person. When the official refereeing the sports event makes a controversial call, a fan oftentimes disagrees with the official's judgment. In this instance, the fan typically does not have an item that can be thrown without potentially injuring another person, ruining the item itself, or damaging any other item that might be contacted by the thrown item. Providing the fan with an item that can be thrown will help the fan release frustration and also feel like more of a participant in the athletic event.

Another scenario in which a thrown item may be of value is in personal relationships. When two people enter into an argument, it may be useful to have an item which can be thrown to signal one person's feelings regarding the argument, therefore potentially halting the momentum of an argument before it starts or increases. The throwing of an item may dissipate the tension between the parties, and also indicate in a playful manner the importance of keeping the argument in perspective. The item to be thrown should not be likely to injure the other participant in the argument, or any item it may contact. It is to overcome the shortcomings in the prior art that the present invention was developed.

SUMMARY OF THE INVENTION

The present invention in general terms concerns a flexible flag for throwing. More specifically, the present invention encompasses a flag having a flexible main body member, a flexible handle member having a first end attached to the main body member, and a throwing weight attached to the main body member. The throwing weight is attached to the main body member adjacent to the intersection of the handle member and the main body member, and is positioned in a pocket formed at the intersection of said main body member and said handle member. The throwing weight is a deformable weighted material.

Accordingly, it is a primary object of the present invention to provide a flag for throwing that is easily gripped and accurately tossed with a minimal risk of damaging any item it comes into contact with.

It is another object of the present invention to provide a flag with a handle and a throwing weight for use in accurately tossing the flag.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
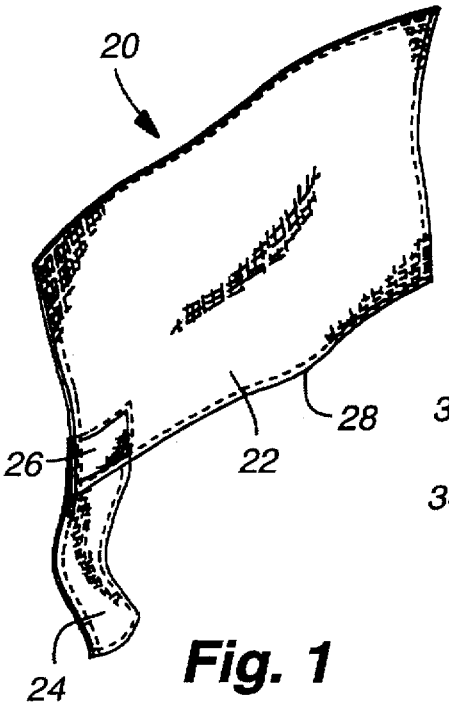
FIG. 1 is a perspective view of a first embodiment of the flag of the present invention, illustrating a flexible main body member, a flexible handle member, and a throwing weight.

Referring first to FIG. 1, an embodiment of the flag 20 for throwing of the present invention is illustrated, and includes a flexible main body member 22, a flexible handle member 24 fixedly attached to a portion of the flexible body member, and a throwing weight 26 attached adjacent to the intersection of the flexible main body member 22 and the handle member 24. To throw the flag 20, a user grips the flexible handle member 24 and tosses the flag in the desired direction. The throwing weight 26 provides trajectory stability which assists in carrying the flag 20 after being tossed to the proposed target (not shown). The throwing weight 26 typically leads the flexible body 22 and handle member 24 of the flag 20 after being tossed.

Figure 2:
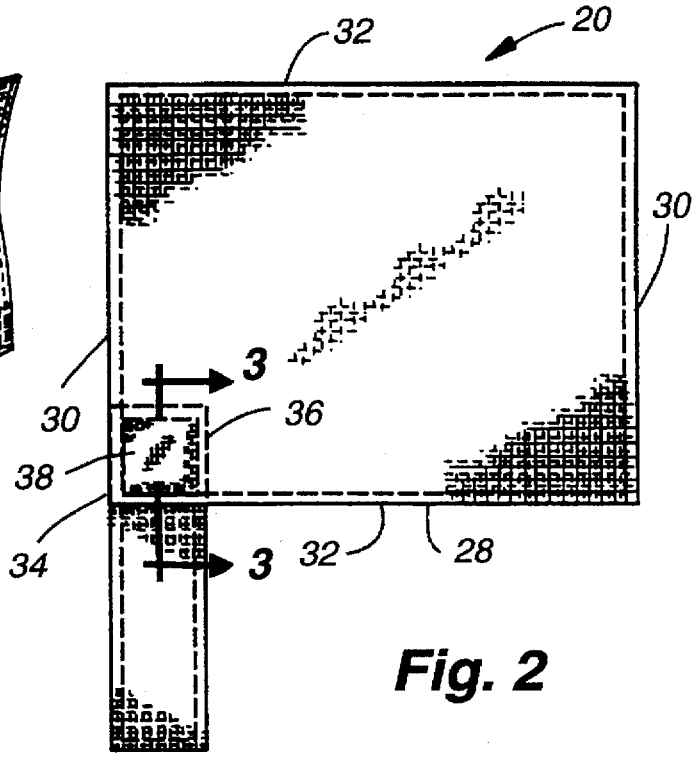
FIG. 2 is a front elevational view of the flag shown in FIG. 1.

In a first embodiment, as shown in FIGS. 1 and 2, the flexible main body member 22 encompasses a flexible material of man-made or natural fibers, having a generally rectangular shape. The rectangular shape is defined by a perimeter 28 having two opposing shorter sides 30, each connected at right angles by opposing longer sides 32. The perimeter of the rectangular shape is hemmed for a finished look. The flexible handle member 24 also includes a flexible material of man-made or natural fibers. The flexible handle member is attached to the main body member 22 by any conventional means, such as sewing.

As shown in FIGS. 1 and 2, the flexible handle member 24 is attached at a corner 34 of the main body member 22 and extends adjacent with and parallel to a longitudinal extension of one of the short sides 30 of the rectangular shaped main body member 22.

Preferably, the flexible handle member 24 is attached to the main body member 22 around a perimeter 36 of the intersection of the two members 22, 24 thereby creating a pocket 38. The pocket thus includes a first wall 40 formed by the main body member 22, a second wall 42 formed by the flexible handle member 24, and a sealed perimeter 36 formed by the method of attachment of the flexible handle member 24 to the main body member 22, such as sewing.

Figure 3:
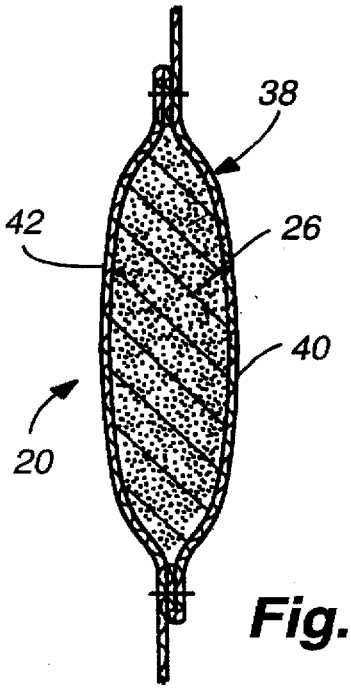
FIG. 3 is a section taken along line 3—3 of FIG. 2.

The throwing weight 26 is best illustrated in FIGS. 2 and 3, and is located within the pocket 38 formed at the intersection of the flexible handle member 24 and the flexible main body member 22. Preferably, the throwing weight 26 includes a deformable weighted material, such as a granular substance like sand, sufficient to provide adequate mass to allow for accurate trajectory, yet deforms upon impact to minimize any damage to the item struck by the throwing weight.

It is important to note that the throwing weight 26 can be a deformable solid or liquid type material providing sufficient mass within the pocket 38 to allow for trajectory stability. It is also important to note that the throwing weight 26 can be located at a position on the flexible main body member 22 or the flexible handle member 24 apart from the intersection between the body member and the handle member. For instance, the throwing weight 26 can be positioned within a pocket formed elsewhere on either the flexible handle member 24 or the flexible main body member 22, or can be simply attached to a side of either the handle member or the main body member. If so desired, the throwing weight 26 can be a rigid solid weighted member with adequate padding to minimize any impact force.

Figure 4:
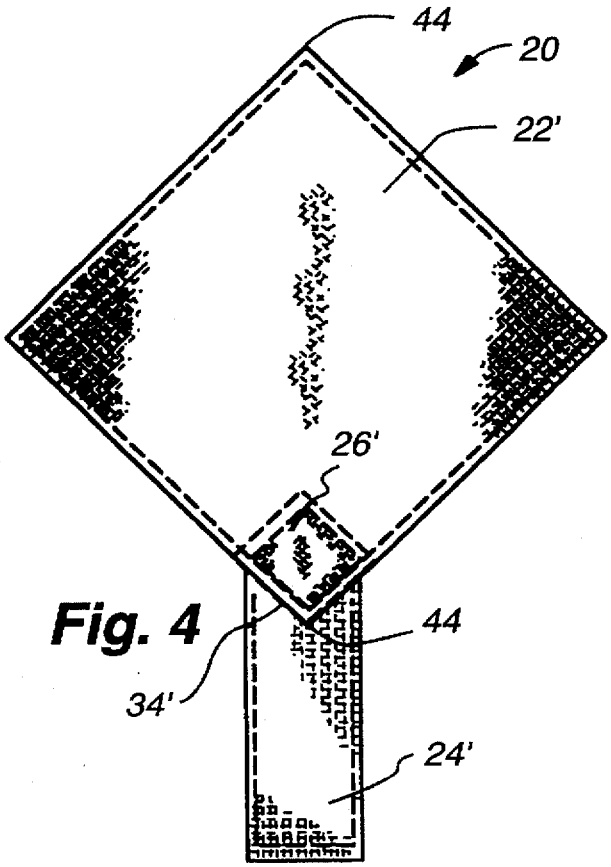
FIG. 4 is a front elevational view of an alternative embodiment of the flag of the present invention, illustrating a flexible main body member, a flexible handle member, and a throwing weight.

Another embodiment of the present invention is shown in FIG. 4, with similar structure noted by the similar number with a prime. This alternative embodiment includes a flexible main body member 22' having a substantially square shape, and a flexible handle member 24' attached to and extending from the main body member. The throwing weight 26', as described above, as shown in FIG. 4, is positioned within the pocket 38' formed by the attachment of the flexible handle member 24' to the flexible body member 22'.

In FIG. 4, the handle member 24' extends from a corner 34' of the flexible main body member 22' in a direction away from the flexible main body member and in line with an extension of a hypothetical line connecting two opposing corners 44 of the flexible main body member 22'.

Logos or other types of information can be imprinted on the flexible main body member 22.

In operation, the user grips the flexible handle member 24 and tosses the flag 20 in the desired direction. The throwing weight 26 leads the flag 20 during the trajectory because the flexible main body member 22 and the flexible handle member 24 are pushed behind the throwing weight 26 by wind resistance. The throwing weight 26 strikes the object at which it is thrown, and the deformable weighted material deforms so as to minimize any damage to the stricken object. If the flag 20 is thrown directly above the user, the throwing weight will cause the flag to return substantially to the position from which it was tossed, so the user can catch the flag and toss it again.

Although the present invention has been described with a certain degree of particularity, it is understood that changes in detail or structure may be made without departing from the spirit of the invention, as defined in the appended claims.

The invention claimed is:

1. A flag for throwing, said flag comprising:

a. a pliant and planar main body member having first and second parallel opposing sides and third and fourth parallel opposing sides, said first and second opposing sides intersecting said third and fourth opposing sides;

b. a pliant handle member having a first end attached to said main body member at the intersection of said first and third sides, and extending outwardly from said main body member parallel to a longitudinal extension of said third side, said handle member having a width less than the length of said first side; and c. a throwing weight attached to said main body member at the intersection of said handle member and said main body member.

2. A flag as defined in claim 1 comprising:

a. a pocket formed at the intersection of said main body member and said handle member; and b. said throwing weight positioned within said pocket.

3. A flag as defined in claim 2, wherein said throwing weight is a deformable weighted material.

4. A flag as defined in claim 2, wherein said throwing weight is a granular deformable mass.

5. A flag as defined in claim 2, wherein said throwing weight is sand.

6. A flag as defined in claim 1, wherein said main body member has a rectangular shape.

7. A flag as defined in claim 1, wherein said main body member has a square shape.

8. A flag for throwing, said flag comprising:

a. a pliant and planar main body member having first and second parallel opposing sides and third and fourth parallel opposing sides, said first and second opposing sides intersecting said third and fourth opposing sides;

b. a pliant handle member having a first end attached to and extending outwardly from said main body member at the intersection of said first and third sides, and extending parallel to and coincident with a longitudinal extension of a hypothetical line connecting the intersection of said first and third sides with the intersection of said second and fourth sides; and c. a throwing weight attached to said main body member at the intersection of said handle member and said main body member.

9. A flag as defined in claim 8 comprising:

a. a pocket formed at the intersection of said main body member and said handle member; and b. said throwing weight positioned within said pocket.

10. A flag as defined in claim 9, wherein said throwing weight is a deformable mass.

11. A flag as defined in claim 9, wherein said throwing weight is a granular deformable mass.

12. A flag as defined in claim 9, wherein said throwing weight is sand.

* * * * *